US005143135A

United States Patent [19]

Kuhar

[11] Patent Number: 5,143,135

[45] Date of Patent: Sep. 1, 1992

[54] LOW PROFILE HEADRAIL VENETIAN BLIND

[75] Inventor: Otto Kuhar, Garfield, N.J.

[73] Assignee: Levolor Corporation, Sunnyvale, Calif.

[21] Appl. No.: 643,388

[22] Filed: Jan. 18, 1991

[51] Int. Cl.[5] ..... E06B 9/38

[52] U.S. Cl. ..... 160/107; 160/176.1; 160/178.2; 160/902

[58] Field of Search ..... 160/107, 168.1, 176.1, 160/177, 173, 178.1, 178.2, 166.1, 902

[56] References Cited

U.S. PATENT DOCUMENTS

| | | | |
|---|---|---|---|
| 2,687,770 | 8/1954 | Walker et al. | 160/176.1 |
| 3,294,153 | 12/1966 | Fountain | 160/176.1 X |
| 3,455,365 | 7/1969 | Stall | 160/178.2 X |
| 3,727,665 | 4/1973 | Debs | 160/168.1 X |
| 3,799,236 | 3/1974 | Debs | 160/178.1 |
| 4,141,402 | 2/1979 | Marotto | 160/176.1 |
| 4,214,622 | 7/1980 | Debs | 160/168.1 |
| 4,621,273 | 11/1986 | Georgopoulos et al. | 160/168.1 |
| 4,846,243 | 7/1989 | Schneider | 160/84.1 |
| 4,875,516 | 10/1989 | Marocco | 160/177 X |
| 4,886,102 | 12/1989 | Debs | 160/177 |
| 4,945,971 | 8/1990 | Ivarsson et al. | 160/178.3 |
| 4,957,152 | 9/1990 | Knight et al. | 160/178.2 X |
| 5,002,113 | 3/1991 | Georgopoulos | 160/176.1 |

*Primary Examiner*—David M. Purol
*Attorney, Agent, or Firm*—Skjerven, Morrill, MacPherson, Franklin & Friel

[57] ABSTRACT

A venetian blind (10) having a low profile headrail (18) is provided particularly useful for double-glazed and/or screened windows. A tilt mechanism (24) extends horizontally and outwardly from one end of the headrail and includes internal drive gearing and a spocket moving a horizontal beaded chain (31) held in a pair of clamping blocks (33) slidably movable to and fro in a guide channel (32) in the headrail. A tilt wand connector includes upper legs insertable into a square bore in a drive gear. The clamping blocks include clamp levers (34) for clamping the upper ends (20*c*) of vertical legs (20*a*) of the tape ladders supporting the blind slats (17) so that the orbital motion of the chain and sliding motion of the clamping blocks pulls or slackens opposite legs (20*a*, 20*b*) of the ladders effecting tilting of the blind slats. A draw cord and mounting screw guide (36) is included in the headrail which minimizes or prevents fraying of the draw cord(s) 21*a*. A combined chain tensioner (60) and cord lock assembly (40) is provided in an end casing (63) insertable into the other end of the headrail.

31 Claims, 7 Drawing Sheets

LOW PROFILE HEADRAIL VENETIAN BLIND

FIELD OF THE INVENTION

This invention pertains to an improved and simplified mechanism for tilting the slats of a venetian blind and for guiding and locking the draw cords in a blind headrail. More particularly, the invention provides a low profile headrail having tilt wand operation in a double-glazed or single glazed pane(s) window with or without a window screen and having an improved cord lock and cord guide to minimize cord fraying.

BACKGROUND OF THE INVENTION

In the past, various constructions of a somewhat low profile headrail have been developed by Levolor Corporation and other venetian blind manufacturers. A first example of a low profile headrail particularly designed for installation between double glazed windows is a standard venetian blind with a headrail having a dimensional profile of about 2 cm high by 3 cm deep where a tilt rod in the headrail is driven by a flexible shaft connected to a blind-exterior knob assembly. The blind is sealed within the window glazing and controlled by the external knob. Since this construction incorporates a typical drum and cradle assembly such as shown in U.S. Pat. No. 4,487,243, the headrail must be sufficiently large in height so as to accept the operating hardware. A sleeker profile, evidenced by the TCR Andersen Window Blind by Levolor, eliminates the use of drums and cradles, and replaces them with a system of stainless steel wires, terminals, and pulleys. In this construction, the upper legs of the ladder tape are secured to a steel cable with brass barbs, which pass through terminal ends. Tilt cords are attached by barbs and eyelets to either end of the steel cable, which then passes around a roller-bearing pulley. Slat tilt is accomplished by pulling on the tilt cords. Although, in this manner, the dimensional profile of the headrail can be significantly reduced, the construction does not permit the use of a conventional tilter and tilt wand. Further, assembly of the product is particularly difficult with regard to accurately measuring and attaching the terminal ends. A partial solution to this problem is seen in U.S. Pat. No. 4,945,971 where a ladder cord has pre-formed apertures in the ladder legs and pins utilized to fix the leg to a bent tongue on the drum or in a bottom rail aperture.

There thus has been the need for a low profile headrail which can be manufactured and assembled with ease and suitable for incorporation into a double-glazed window assembly or used in a standard window. This would result in enhanced functional operation by quickly, dependably and smoothly tilting the blind slats while providing for improved operation of the draw cords for lowering and raising and locking a stack of slats making up the blind.

Most venetian blinds of the prior art have headrails having a height of from about 2 cm to 2.5 cm, with a depth of from about 3 cm to 4 cm. Such large dimensioned headrails cannot be installed on restricted mounting surfaces nor would they fit within the narrow horizontal air space typical of double glazed windows.

Chain drives, exemplified by U.S. Pat. Nos. 4,214,622 and 4,621,273 have been employed in headrails to effect the tilting of the blind slats. The chains are driven by a sprocket. Such designs and other standard tilt mechanisms involve a large amount of sub-assembly and a large number of parts to construct the product. For example, in the cable-cord tilter system described above, a total of 43 parts are employed in a two-ladder blind, 55 parts in a three-ladder blind and 67 parts in a four-ladder blind. The number of ladders are dictated by the overall width of the blind and slats and the number chosen prevents the sagging of the normally employed thin metal slats forming the blind.

A problem in blinds having a low profile is that the draw cords which pass through slat apertures from an anchored position in a blind bottom rail must pass laterally through the headrail to an end locking mechanism and cord outlet and thence alongside the blind slat ends for manipulation by a user. Generally headrail mounting screws or other fasteners pass freely through the headrail and are threaded or connected into a wood or other window upper horizontal frame portion. Often the installation screws pinch and cut or fray the lift or draw cords as the lift cords move in the headrail. This problem is amplified in small, low profile headrails due to the close clearances therein.

Further, as the height of a headrail becomes smaller it is more difficult to accommodate the conventional cord lock employed in venetian blinds where the cords are passed over a horizontal roller or pin and then passed down vertically through the cord lock. Such cord locks as exemplified in U.S. Pat. No. 3,799,236 rely on gravitational forces to move a roller cam into position against the draw cords with the cam's knurled surface locking or jamming the cord securely against the roller or pin. This construction necessitates a relatively high headrail. Thus there has been a need to have a cord lock which can effectively operate in a low profile headrail.

SUMMARY OF THE INVENTION

The present invention provides a low profile top rail or head channel of the order of about 1 cm high by about 2.6 cm deep while allowing tilt operation by a tilt wand. A pair of movable clamping blocks are provided in a U-shape headrail guide channel which operate in a horizontal to and fro direction with the headrail longitudinal axis. The distal upper ends of the legs of the tape ladders of the tilt mechanism are fixed to the clamping blocks by pivot levers, the distal ends thus also moving oppositely to and fro in the guide channel. This is unlike most venetian blinds where the ladder ends rotate around (are wound on) a rotating drum. A looped orbital chain is press-fitted to both clamping blocks and is gear and sprocket moved and driven by a tilt wand mechanism. The ladder legs on opposite clamping blocks are pulled by the to and fro motion of the blocks and chain to thereby tilt the slats of the blind. A combined chain tensioner and blind raising and lowering cord lock assembly are provided in an end casing which is mounted at one end of the blind headrail. A combined cord and mounting screw guide which minimize or prevents cord fray is also associated with guide channel. The other end of the headrail mounts a second end casing containing the chain drive gearing and an extension for insertion of a tilt wand and an improved connector rod.

DETAILED DESCRIPTION

Figure 1:
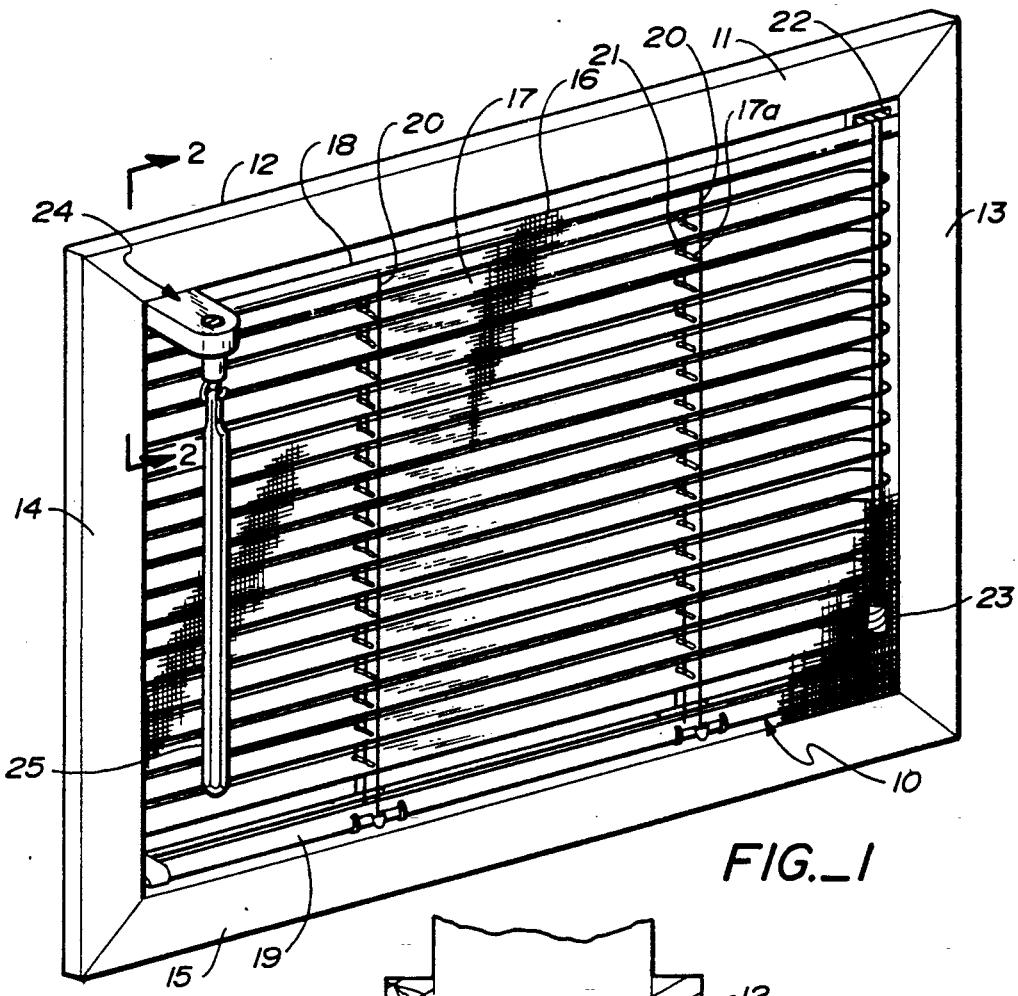
FIG. 1 is a perspective view showing the blind in a fully extended position mounted in a screened double-glazed window.
Figure 2:
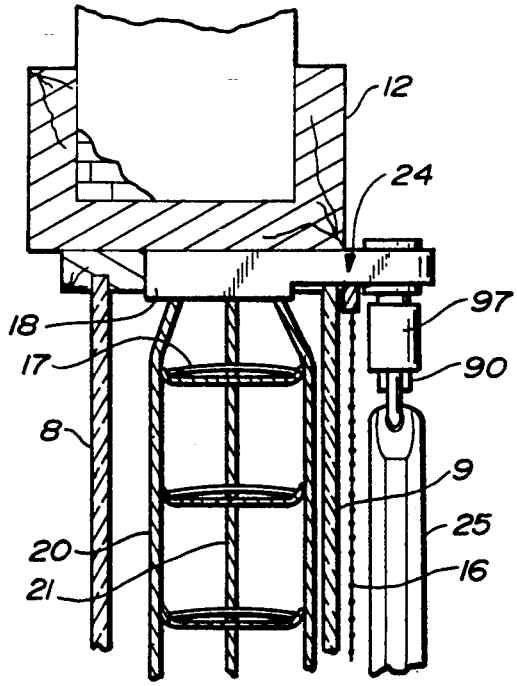
FIG. 2 is a partial side view of the headrail taken on the line 2—2 of FIG. 1.

FIG. 1 illustrates the low profile venetian blind 10 of the invention mounted in a window frame 11 having a top section 12, side sections 13 and 14 and bottom section 15. The blind 10 has conventional elements namely a series of parallel horizontal slats 17, a pair of slat ladders 20 supporting the slats and functioning by operation of a tilt mechanism 24, to tilt the slats to various open and closed positions by rotation of wand 25, a bottom rail 19, and draw cords 21 extending through slat apertures 17*a* and fixed to the bottom rail. Draw tassels 23 are employed for pulling the cords through a headrail exit 22 to raise the blind slats. A headrail 18 is mounted normally in or on the window upper section 12. As seen in FIG. 2 the blind headrail of the present invention has such a low profile that the slats and headrail may be fitted between double panes of glass 8 and 9 and, if desired, exterior of an interior insect screen 16 mounted in the window. The present invention basically is directed to improvements in the headrail internals which provide for improved tilting of the slats, locking and threading of the lift cords and tilt ladder legs, and locking of the blind at various vertical positions.

Figure 3:
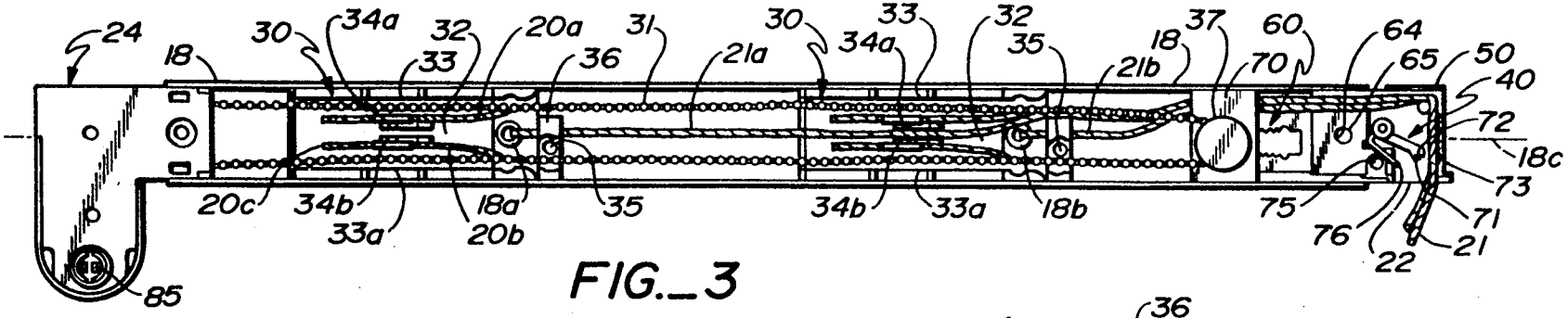
FIG. 3 is a top view of the blind headrail with the cord lock top cover removed.

FIG. 3 shows the improved constructions including a low profile headrail 18 of flat U-shape (in end view) into which an encased tilt mechanism 24 is inserted and connected at one end and an encased cord lock mechanism 40 is inserted and connected at the opposite end of the headrail. Connection is made of each case by a hollow rivet 65 extending between the case bottoms and an aperture 64 in the headrail bottom surface. A beaded chain 31 such as a polyurethane covered stainless steel cable with spaced acetyl plastic beads molded thereon is driven orbitally in clockwise and counter-clockwise increments to effect a pulling of opposite legs of the slat ladders to tilt the slats. A guide base and clamping block mechanism 30 is provided for connecting the beaded chain to the tilt ladder tapes normally of woven cord. This mechanism includes a pair of U-shaped guide channels 32 each having a bottom wall 32*a* and side walls 32*b* and 32*c* which are fixed and spaced in the head channel 18. Additional guide channels are employed in the case of three or four-ladder blinds. The guide channels preferably are fabricated from a self-lubricating plastic such as Celcon acetal thermoplastic manufactured by Hoechst Celanese. A pair of junction or clamping blocks 33 also of Celcon plastic or other self-lubricating material are slidably positioned in each guide channel 32. Each clamping block includes a locking lever 34*a*, 34*b* for locking a distal end 20*c* of normally woven thread ladder legs 20*a*, 20*b*. Adjacent junction blocks and levers slidable in a particular one of the guide channels are positioned on opposite sides of the originally free orbital chain 31. During assembly, opposite portions of the beaded chain are press-fitted into bead apertures or cavities 38 (FIG. 4) in the clamping blocks 33 providing a means (the beaded chain) for pulling the blocks to and fro longitudinally with respect to the fixed guide channel 32 in which they are slidable. Each clamping block has a side extension 43 providing a cord ramp which preferably has an aperture or depression 43*a* therein into which a ladder cord leg distal end 20*c* is clamped. Clamping is effected by pivoting a locking lever 34*a*, 34*b* as indicated by the curved arrows so that the distal end 20*c* is jammed into aperture 43*a* or against the ramp surface of extension 43.

The beaded chain is positively driven in clockwise and counter-clockwise increments by manual rotative motion of the tilt wand 25 and operation of the tilt mechanism 24 which transmits wand torque through appropriate gearing (FIG. 21) to a sprocket which transmits longitudinal orbital motion to the chain. Chain motion thus results in longitudinal sliding motion of the clamping blocks 33 within the channels 32 and the resultant pulling or slacking of opposite legs of the slat ladders to effect slat tilting. In an alternative configuration a single pair of clamping blocks may be employed with one distal end of one of the ladder legs associated with each clamping block fixed with respect to the guide channel.

Figure 14:
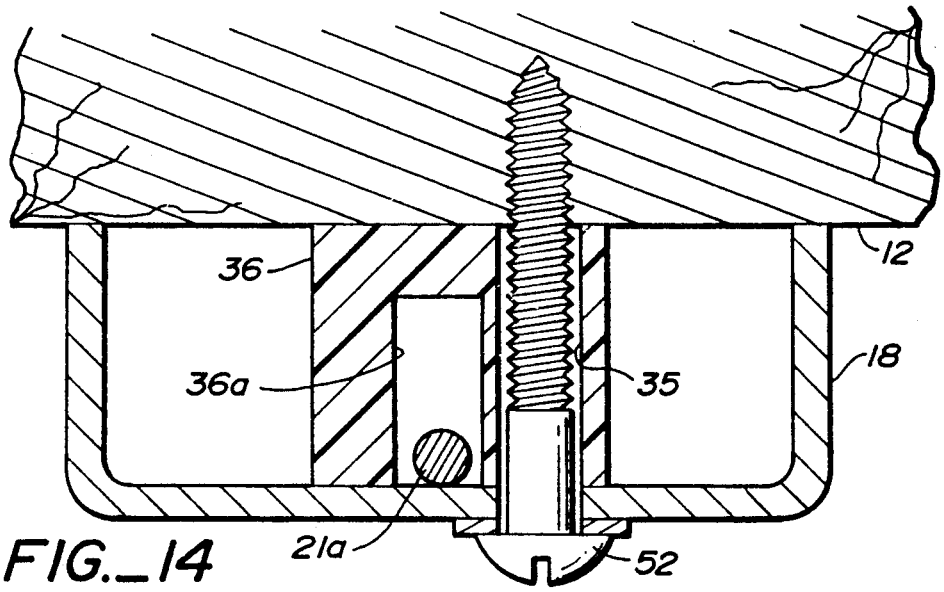
FIG. 14 is a cut-away side view of the headrail and cord guide showing a blind mounting screw.

The draw cords 21*a* are guided within the headrail by a pair of upstanding vertical inverted U-shaped guides or gates 36 preferably integral with guide channels 32 which are fixed to the headrail. The guides 36 which also may be separate parts molded of Nylon or Celcon plastic, include a guide tunnel or gate opening 36*a* through which a draw cord 21*a* passes. Each of the guides include a side leg having a bore 35 through which a mounting screw 52 (FIG. 14) passes to mount the headrail 18 and overall blind to the window section 12. Thus the mounting screw passing through this protective plastic housing does not and cannot contact the cord 21*a* or the beaded chain 18 causing fraying, abrasion, tangling or pinching of the cord. Further, the guide 36 provides an internal vertical support preventing overdriving of the screw which would otherwise tend to compress, crush or flex the headrail.

Figure 4:
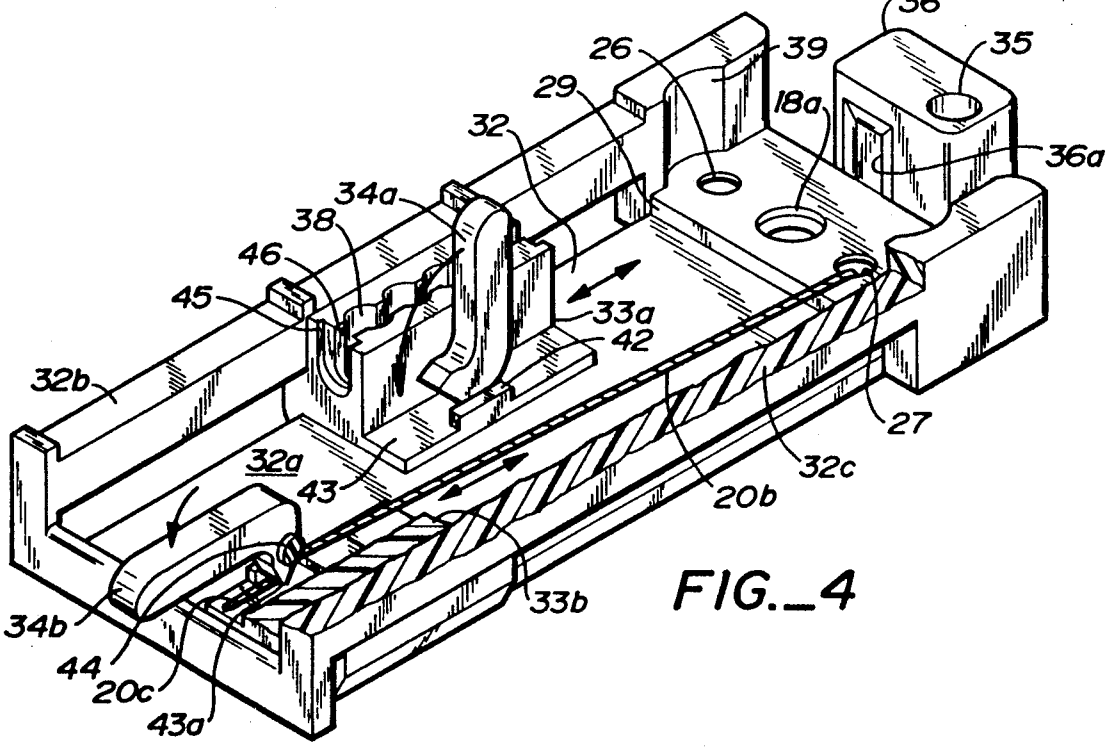
FIG. 4 is a detailed partially cut-away perspective view of the clamping blocks and tape lock levers showing the assembly in a guide channel.
Figure 5:
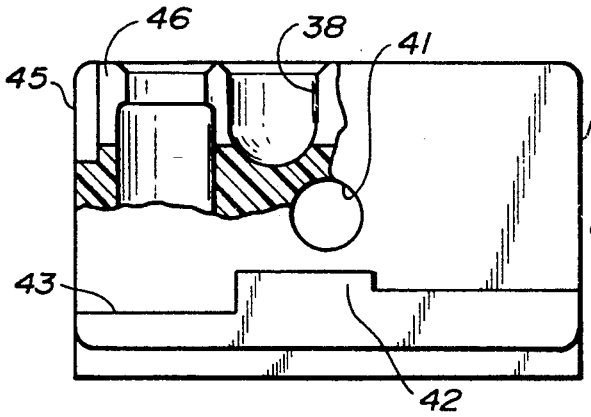
FIG. 5 is a partially cut-away side view of the clamping block.
Figure 7:
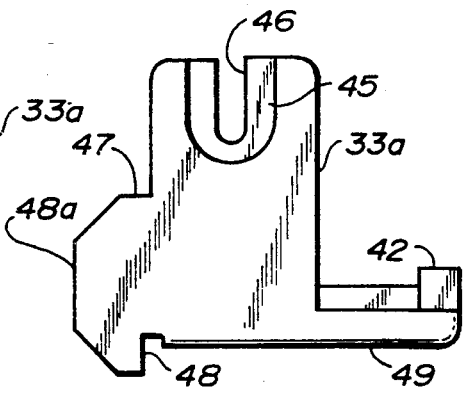
FIG. 7 is a left-hand end view thereof.
Figure 6:
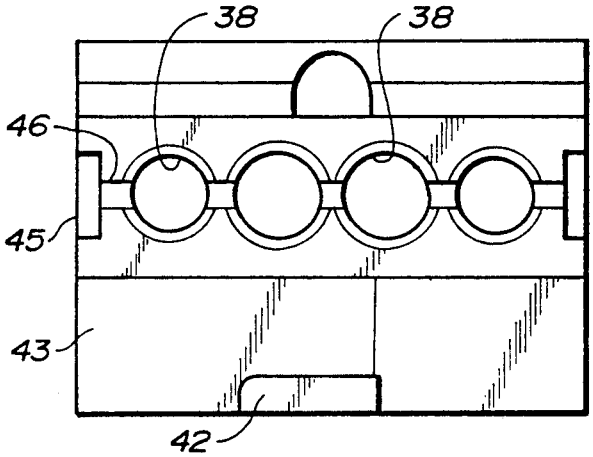
FIG. 6 is a top view thereof.
Figure 8:
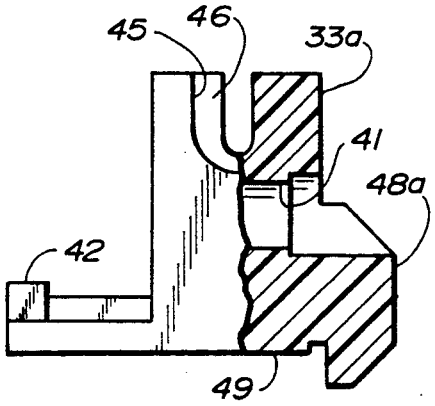
FIG. 8 is a right-hand end partially cut-away view thereof.
Figure 9:
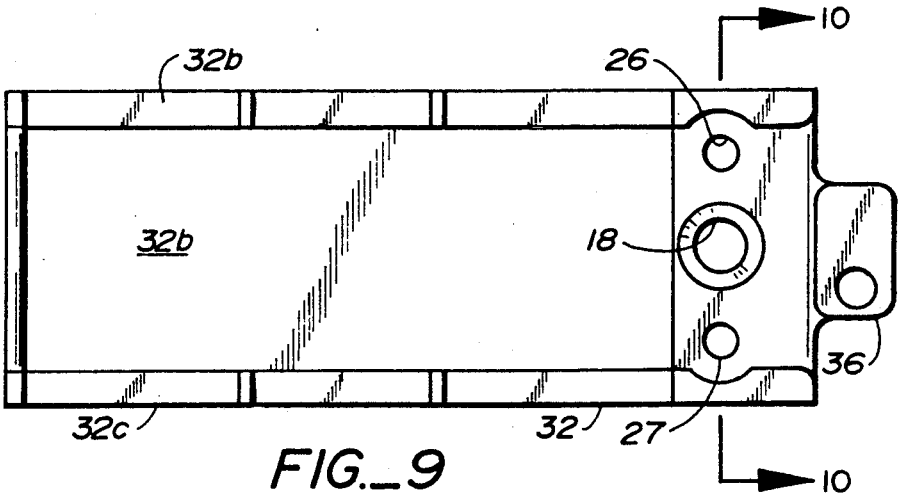
FIG. 9 is a top view of the guide channel per se.

The beaded chain 31 is pulled around a pulley guide 37 positioned at an opposite end of the chain from its driven end. The pulley guide is movable along cooperating ratcheted surfaces on the pulley guide and on legs of a tensioning assembly 60 which is fixedly mounted in the headrail. The tensioning assembly 60 is preferably integral and shares a common base with a cord lock assembly 40. The interaction of the ratcheted pulley and the chain tensioner provides a means for initially tensioning and holding the chain in position during assembly and maintaining the chain tension until blind installation. After the blind is installed, the weight of the slats and bottom rail provides for adequate tensioning of the chain. The pulley guide serves as a fixed pulley around which the beaded chain travels. The orientation of the junction blocks impacts the amount of friction created by the beaded chain. When the junction blocks are orientated as shown in FIGS. 3 and 4, the weight of the blind creates friction on the gearing assembly rather than the tensioner. This is desirable, and adds to the performance of the tilt assembly. If the orientation of the junction blocks were to be reversed, the additional friction on the pulley would impede the operation of the blind.

The cord lock assembly 40 is encased in an end casing 50 insertible into the head channel right end and connected thereto by an rivet eyelet 65 extending in aperture 64. The assembly 40 includes a spring-operated cam arm 71 of acetal plastic with an integral spring arm 76 which acts to force a distal serrated or knurled end 72 of the cam arm against cords 21 and the cords against a serrated interior surface 73 of casing 50 to jam the cords therebetween, as seen in more detail in FIG. 19. When the cam is withdrawn as the blind is raised, the cords pass over a smooth radius 72*a* of the cam totally avoiding the knurled or serrated end, again preventing unnecessary wear to the cords. When the cords are released following cocking of the spring arm 76 the stored energy in the spring forces the cam arm 71 to pivot laterally (counterclockwise) to move the serrations 72 into clamping contact with the cords as indicated by the upper arrow 91 in FIG. 19 to lock the blind slats in a desired vertical position with respect to the window.

Figure 13:
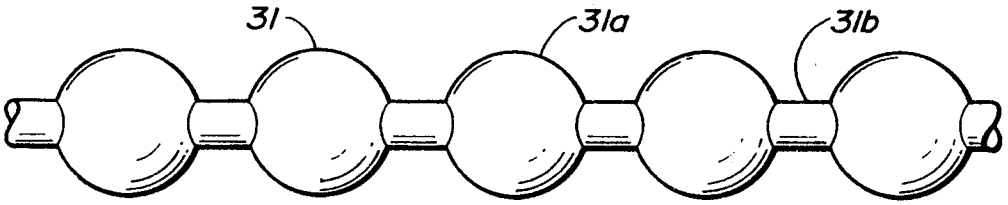
FIG. 13 is a side view of a beaded chain section.
Figure 11:
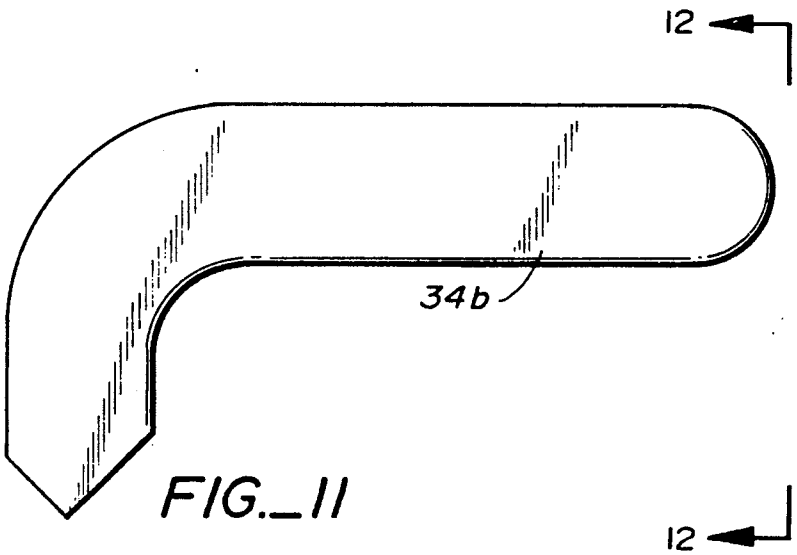
FIG. 11 is a side view of the lock lever.
Figure 10:
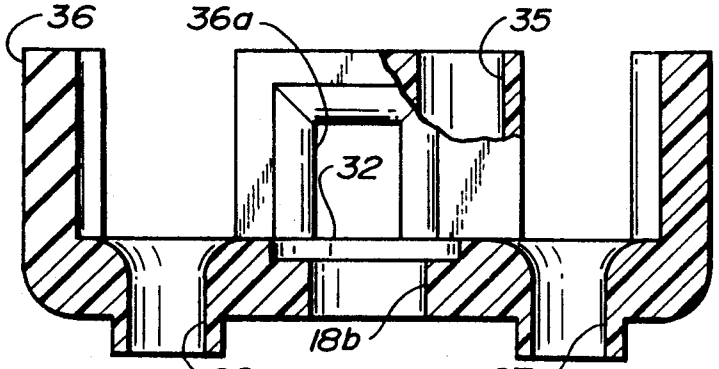
FIG. 10 is a partial cut-away cross-sectional view thereof taken on the line 10—10 of FIG. 9.
Figure 12:
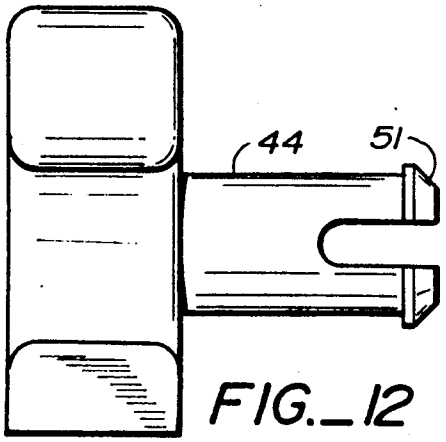
FIG. 12 is a end view thereof.

FIG. 4 is a detailed view of the channel guide 32 and a pair of clamping blocks 33*a* and 33*b*. Levers 34*a* and 34*b* clamp distal ends 20*c* (one being shown) of the ladder legs 20*b*. The lever 34*a* is shown in an "UP" position prior to threading a distal end of a ladder leg along extension 43 and its ramp surface. Guide ridge 42 aids in guiding the ladder leg end into the ramp. Lever 34*b* is shown in the "DOWN" clamp position having been moved 90° around pivot 44 to clamp the ladder leg distal end in aperture 43*a*. About four beads 31*a* (FIG. 13) of the beaded chain are press-fitted into four cavities 38 in the clamping blocks (the upper part of block 33*b* is not shown in FIG. 4). As the beaded chain is then moved in blind slat tilting operation, block 33*a* moves in one direction along guide 32 while block 33*b* moves in an opposite longitudinal direction (see double headed arrows) thus causing a pulling force on one ladder leg and a slackening of the other ladder leg permitting and causing the series of slats to tilt in one direction or the other dependent on the particular direction of movement of the blocks.

The beaded chain enters the clamping blocks through bead apertures 45 and is held in place by a gap 46 through which the bead connector portions 31*b* (FIG. 13) pass. Ladder leg aperture portions 26 and 27 extend through an end of channel guide 32. A relief channel 39 in the channel sidewall facilitates threading of the ladder legs from the slats to the clamping blocks and permits a round punch or drill to punch the through apertures in plastic guide 32. A rivet eyelet in aperture 18*a* fixedly connects the channel guide to the bottom of the headrail. The cord guide 36 guides the pull cords to the cord lock without tangling and fraying. The edge 29 of a raised end portion of the channel guides functions as a stop for each of the associated blocks 33*a* and 33*b* dependent on the particular orbital direction of the beaded chain as dictated by the rotation direction of the wand.

FIGS. 5–8 show the clamping block detail particularly a series of guide surfaces 47, 48, 48*a*, 49 which extend complementary to longitudinal slide surfaces on the guide channel 32. In addition, a side aperture 41 is shown for reception of pivot 44 of a clamp lever. FIGS. 9–12 show the guide channel 32 and locking lever 34*b* in detail including an integral guide 36 and pivot pin snap-in ridge 51 on the lever pivot pin 44 which snaps into aperture 41 of the clamping block.

Figure 15:
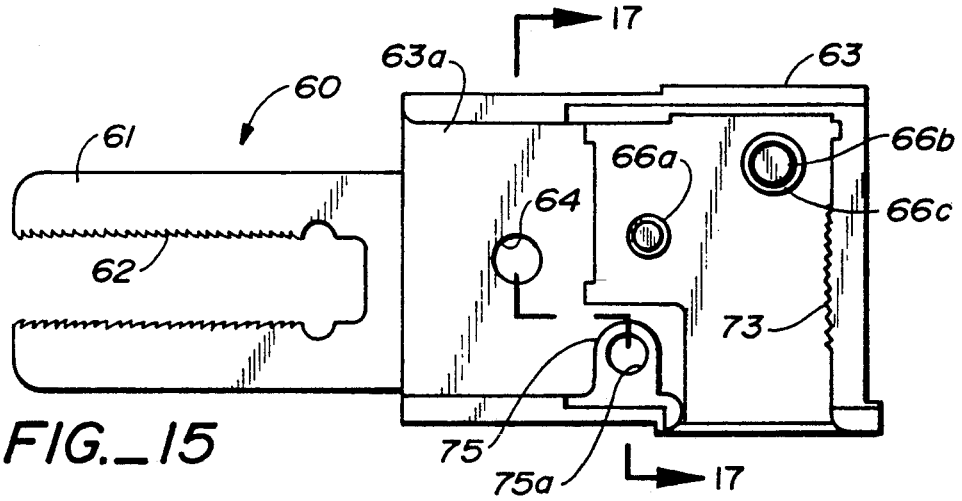
FIG. 15 is a top view of the bead chain tensioner and cord lock body assembly forming a headrail end section.
Figure 16:
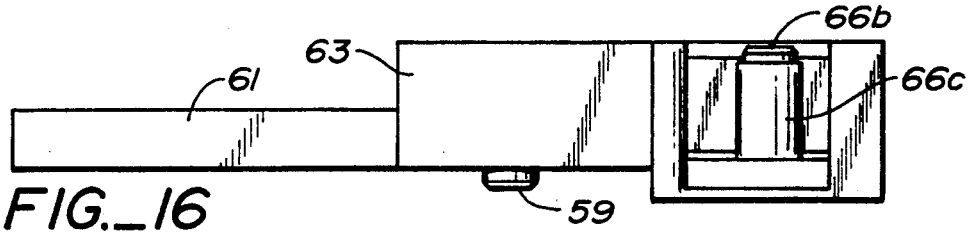
FIG. 16 is a side view thereof.
Figure 17:
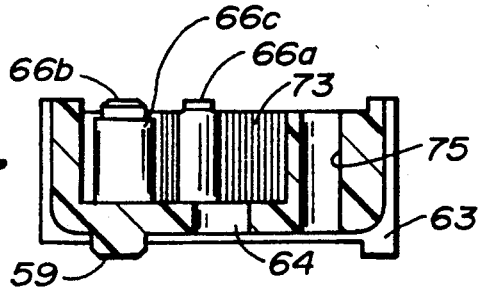
FIG. 17 is a cross-sectional view taken on the line 17—17 of FIG. 15.
Figure 18:
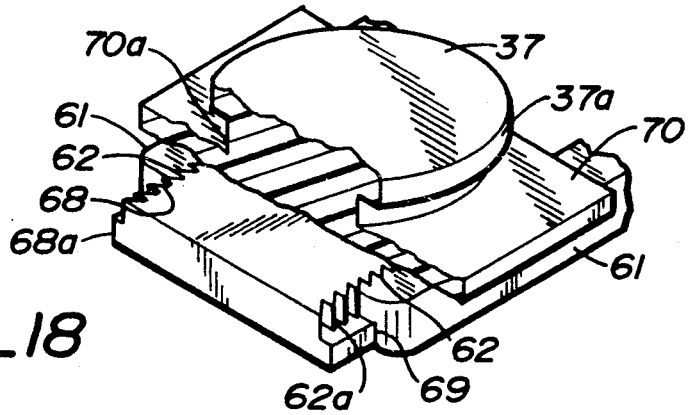
FIG. 18 is a partial cross-sectional perspective view of the beaded chain guide in the bead tensioner.

FIGS. 15–17 show the fixed portion of the tensioner assembly 60 in which a pair of integral legs 61 extend from a base 63*a* in a U-shaped configuration. The legs have serrations 62 on their facing surfaces and the legs have slight flexibility so that they can be slightly spread by inward movement of matching serrations 622 on the pulley guide as seen in FIG. 18. The other end of base 63*a* forms a casing 63 which is insertible into the headrail right-hand end (FIG. 3) and mounts the cord lock mechanism 40.

Figure 19:
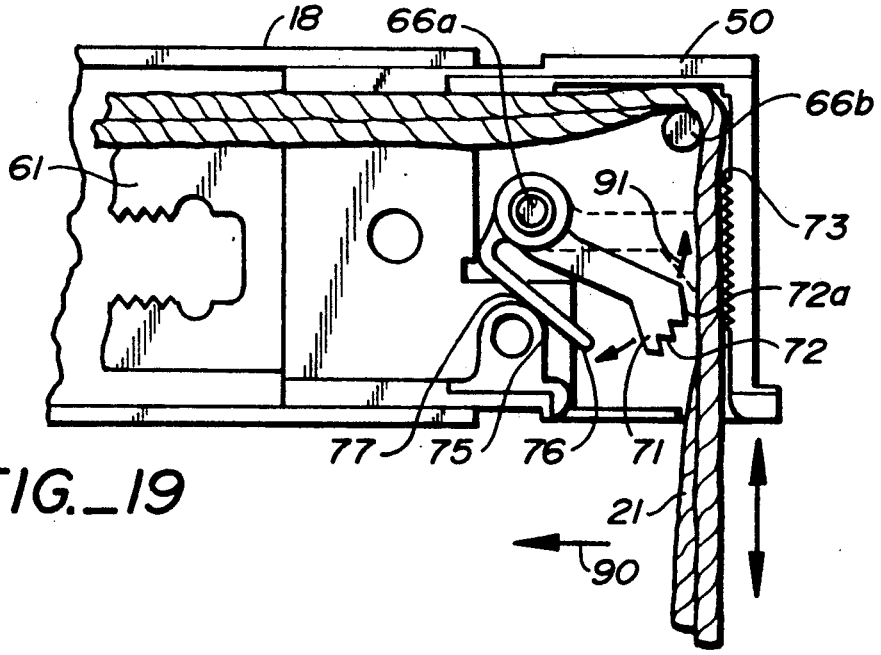
FIG. 19 is a top view of the spring cam in non-cocked position prior to cord locking.

The tensioner and cord lock casing 63 is eyelet mounted to the headrail through an aperture 64 therein. Pins 66*a* and 66*b* extend integrally upward from base 63*a*, the center/pin 66*a* being a pivot for the locking cam and the corner pin 66*b* provides pulley for the lift cords. Corner pin 66*b* has a metal sleeve 66*c* which fits over the pin to prevent wear to the pin from cord movement thereover. Aperture 75*a* serves to locate and fix the casing while the post 75 acts to abut and create a return spring force on spring arm 76 (FIG. 19). A serrated or knurled surface 73 is provided on a casing interior surface against which locked cords abut. A locating pin(s) 59 are normally provided extending from the bottom of the tensioner and into a bottom aperture in the casing 63.

FIG. 18 show the interaction of guide pulley 37 and the tensioner arms 61. An intermediate longitudinal vertical part 68 of the pulley 37 has transverse serrations 622 which interfit with tensioner arm serrations 62. A lower longitudinal pulley part 68*a* rides longitudinally under opposed grooves 69 in the bottom of the arms 61 such that the pulley can be pushed longitudinal with the outer edges of the pulley base 70 sliding along the headrail side edges (FIG. 3). A circular or semi-circular post 70*a* extends from an upper top flange 37*a* upon which the looped chain moves around post 70*a*. Movement of the guide pulley 37 to the right incrementally tensions the looped chain as the serrations 622 move into succeeding ones of serrations 62 in the arms 61.

Figure 20:
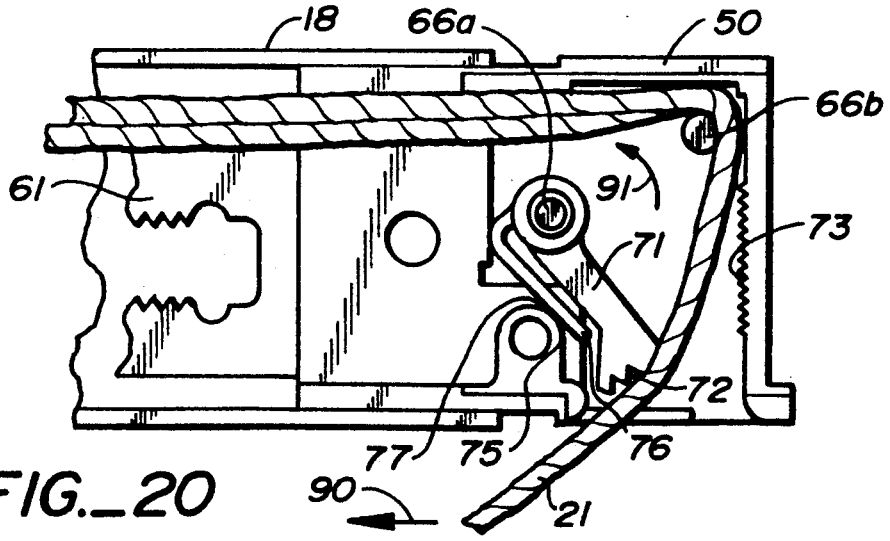
FIG. 20 illustrates cord orientation causing "corking" of the spring of the spring-operated cam arm.

In FIG. 19 the cords 21 extend vertically downward from the headrail exit and do not touch the spring-operated cam 71. In this orientation the blind slats and bottom rail can be raised or lowered to any desired horizontal level of opening. Movement of the cords 21 to the left as indicated by arrow 90 and shown in FIG. 20 forces arm 71 to pivot clockwise allowing spring arm 76 to compress and ride up on post surface 77 providing stored spring energy which, when the cords are brought back quickly to a loose vertical portion, the stored energy in the spring 76 releases to quickly rotate arm 71 counterclockwise (arrow 91) to the dashed position in FIG. 19 essentially along the headrail longitudinal axis where the cords are clamped between cam end serrations 72 and the case serrations 73. In a preferred embodiment, the serrations comprise two rows of six pyramid shaped bosses which are effective in clamping the cords. In the spring "cocked" position, the outer end of spring arm 76 actually contacts cam arm 71. In the cords clamping position, the part of the spring adjacent the shown bend abuts the post 75. Pin 66*b* guides the two cords 21 into position to be locked by the spring-operated cam.

Figure 22:
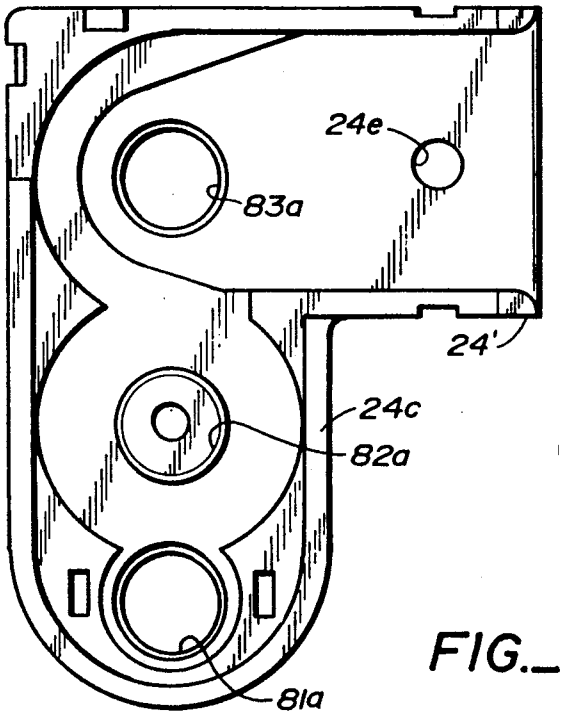
FIG. 22 is a top view of the tilter housing interior.
Figure 21:
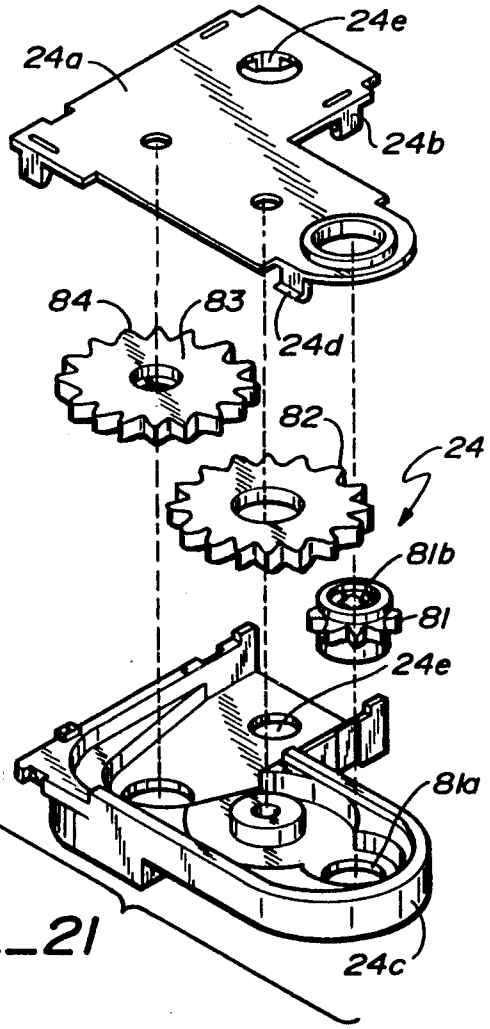
FIG. 21 is an exploded view of the tilter assembly.

FIG. 21 and 22 show the details of the tilter mechanism 24 in which a first drive gear 81 is positioned above opening 81*a*, an intermediate rotatable gear 82 is pinned and positioned in depression 82*a* and a pinned rotatable sprocket gear 83 provided in aperture 83*a* for driving the beaded chain. The gear and sprocket assembly preferably has a 2:1 transmission reduction and provides for an easily operable and detachable tilt wand with a smooth and positive motion to tilt the, blind slats in either direction. The casing end 24' is fixed in the left end of the headrail 18 (FIG. 3) by a rivet eyelet extending through aperture 24*e* after a cover 24*a* is snapped into casing bottom 24*c* with tabs 24*b* and 24*d*.

Figure 23:
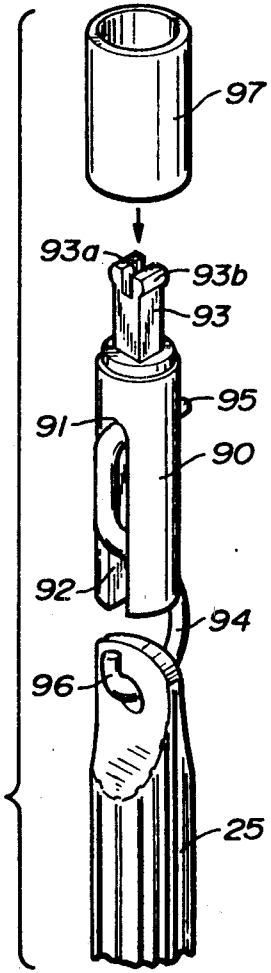
FIG. 23 is a perspective view of the improved wand connector.

An S-shaped wand connector (FIG. 23) as is known in the art is provided to rotatively connect the tilt wand 25 to an improved connector rod 90. An upper end of the connector rod is detachably secured in a square interior bore 81*b* of gear 81. The cylindrical connector rod 90 includes a transverse aperture 91 in mid-span for receipt of an upper horizontal linear portion 95 of the S-connector. A U-shaped channel 92 is formed by bifurcated legs extending from the bottom of the rod and a curved portion 94 of the S-connector passes therethrough for transmitting wand torque. The lower end 96 of the S-connector is attached in an aperture at the top of wand 25. The upper part of rod 90 includes a pair of spaced bifurcated legs 93 which together form a square cross-section and which are insertible into the underside of square bore 81*b* of gear 81. Outer linear top edges of the legs form a curved outwardly extending holding ridge 93*b* which removably holds the rod in the gear square. A groove 93*a* between the legs provides for leg flexibility so that the rod can be pushed into or pulled out of the gear 81. A plastic sleeve 97 is pushed down over the rod to a position extending along the rod mid-span to prevent the S-connector from disengaging from the rod.

The present construction has certain advantages over previous designs with regard to its assembly and manufacture. No fasteners are required during the pre-assembly operations of component parts. During final assembly, individual component parts are snapped into position in the headchannel, or dropped into place and retained by snap-fit covers. Assembly time is decreased, and part inventory is reduced. The traditional blind construction requires ladder tapes to be pre-cut to size, barbs attached to the ladder legs, ladder legs linked together with connectors, and fed continuously through a venetian blind assembly machine, where the length of the tape dictates the length of the blind. In the present invention, the tape is fed, without being pre-cut, to the assembly machine eliminating both the leg connectors, brass barbs, and the time required to cut and link the ladder sections. The length of the blind is set by the slats, which are automatically placed into position by the assembly machine. The ladder is then cut to size accordingly. The ladder legs are then positioned and locked in place in the blocks with the right and left lock levers. The head loop, the distance from the edge of the ladder leg to the first cross member, is adjusted at the lock lever position with greater accuracy and facility than traditional constructions. The two barbs on the bottom of the ladder tape have been replaced by one eyelet through which the ladder legs are passed. The eyelet is crimped to both legs, simultaneously, and pressed into the bottom rail. This operation provides ease and accuracy over the tradition method of attaching the bottom rail. With the traditional method, the length of the blind is dictated by the length of the ladder which permits ladder substitutions and adjustments at the final assembly station. The traditional low profile headchannel, requires a system of stainless steel wire and terminal ends to be pre-cut and accurately assembled at pre-assembly stations. The present invention eliminates the pre-assembly operations. Beaded chain is cut to size at the final assembly station, snapped into the junction blocks as an endless beaded chain, and secured under tension with the chain tensioner.

The above description of the preferred embodiment of this invention is intended to be illustrative and not limiting. Other embodiments of this invention will be obvious to those skilled in the art in view of the above disclosure.

I claim:

1. A venetian blind having a series of horizontal slats extending from a headrail, said headrail containing a slats-tilting mechanism and means for raising the slats to a slats stacked position and for lowering the slats to an extended position, said slats-tilting mechanism comprising:

at least one elongated guide channel fixed in said headrail along a headrail longitudinal axis;

at least a pair of clamping blocks in said channel, each being movable in said channel in a to and fro direction parallel to said headrail axis;

at least two slat ladders, each having two ladder legs with upper distal ends;

means for fixedly attaching distal ends of the ladder legs to said clamping blocks;

a looped chain having spaced portions fixed to said clamping blocks; and means for driving said chain in incremental orbital directions such that the ladder legs of each pair of ladder legs are pulled in opposite directions to and fro by driven motion of said looped chain to thereby tilt said slats.

2. The venetian blind of claim 1 in which said clamping blocks include a series of chain-receiving apertures for fixedly holding a series of chain components.

3. The venetian blind of claim 2 in which said chain is a beaded chain and said chain components include a series of beads spaced on a central core, spaced ones of said beads being press-fitted into said clamping block apertures.

4. The venetian blind of claim 3 in which said clamping blocks and said at least one channel are of self-lubricating plastic construction and said clamping blocks are movable in sliding engagement with a bottom wall and a side wall of said at least one channel.

5. The venetian blind of claim 4 in which each of said clamping blocks includes a bottom apertured extension extending to a position in said at least one channel, and wherein the means for fixedly attaching the distal ends of the ladder legs to said clamping blocks comprises a lock lever jamming the distal ends into the apertures of each of said bottom extensions.

6. The venetian blind of claim 5 in which said means for driving said chain comprise a gear sprocket in driving tooth connection to said looped chain, a tilter drive gear in toothed connection to said gear sprocket and a tilt wand connected to said drive gear, said wand being torqueable to move said drive gear in clockwise and counter-clockwise directions to rotate said gear sprocket and move said looped chain and said clamping blocks to and fro in said at least one channel to lift opposed ladder legs of said ladders to tilt said slats.

7. The venetian blind of claim 6 further including a wand connector rod having a lower end connected to said wand and an upper end removably insertible into said drive gear.

8. The venetian blind of claim 7 wherein said drive gear includes a squared bore and said connector rod upper end includes a pair of spaced flexible legs having an overall square configuration insertible into said gear squared bore.

9. The venetian blind of claim 6 further comprising a housing encompassing said gear sprocket and said drive gear, said housing extending orthogonally from an end of said headrail such that said wand is spaced outwardly of said slats in a slats fully-opened tilt position such that an insect screen can be positioned between said wand and said headrail.

10. The venetian blind of claim 6 further including a chain guide spaced from said clamping blocks at an end of said headrail opposite said gear sprocket, said chain guide being movable longitudinally in said headrail to tension said chain.

11. The venetian blind of claim 10 wherein said chain guide includes a ratcheted base in ratchet connection to a ratcheted support fixed in said headrail, for translating said chain guide along said headrail axis to tension said chain.

12. The venetian blind of claim 1 further comprising a pair of draw cords extending through a pair of spaced apertures in each of said slats, said draw cords being anchored in a bottom rail of said blind and extending through said at least one channel and through a headrail end outlet, and a cord lock, said cord lock comprising a guide pin adjacent a rear corner of said headrail, said cords being positioned to extend between said pin and said headrail corner, and a spring operable cam pivotably mounted with respect to said headrail and having a distal end pivotably movable across said end outlet for jamming and locking said cords between said distal end and a headrail interior surface.

13. The venetian blind of claim 12 including a cord lock housing connected to an end of said headrail, said housing including said headrail end outlet, said cord lock and said headrail interior surface.

14. The venetian blind of claim 13 wherein said cord lock housing is fastened into said headrail end and a distal end interior surface is serrated.

15. The venetian blind of claim 1 further comprising a pair of draw cords extending through a pair of spaced apertures in each of said slats, said draw cords being anchored in a bottom rail of said blind and extending through a portion of said at least one channel, through a headrail end outlet and through an inverted U-shaped gate connected to a bottom of said headrail, said gate having a through aperture for guiding said draw cords in said at least one channel and a gate leg having a vertical bore for reception of a headrail mounting screw preventing compression of said at least one channel and preventing the draw cords from fraying.

16. The venetian blind of claim 1 in which said clamping blocks and said at least one channel are of self-lubricating plastic construction and said clamping blocks are movable in sliding engagement with a bottom wall and a side wall of said at least one channel.

17. The venetian blind of claim 1 in which each of said clamping blocks includes a bottom apertured extension and wherein the means for fixedly attaching the distal ends of the ladder legs to said clamping blocks comprises a lock lever jamming the distal ends into the apertures of each of said bottom extensions.

18. The venetian blind of claim 1 in which said means for driving said chain comprise a gear sprocket in driving tooth connection to said looped chain, a tilter drive gear in toothed connection to said gear sprocket and a tilt wand connected to said drive gear, said wand being torqueable to move said drive gear in clockwise and counter-clockwise directions to rotate said gear sprocket and move said looped chain and said clamping blocks to and fro in said at least one channel to lift opposed ladder legs of said ladders to tilt said slats.

19. The venetian blind of claim 18 further comprising a housing encompassing said gear sprocket and said drive gear, said housing extending orthogonally from an end of said headrail such that said wand is spaced outwardly of said slats in a slats fully-opened tilt position such that a glazing or an insect screen can be positioned between said wand and said headrail.

20. The venetian blind of claim 1 further including a chain guide spaced from said clamping blocks at an end of said headrail opposite said means for driving said chain, said chain guide being movable to tension said chain.

21. The venetian blind of claim 20 wherein said chain guide includes a ratcheted base in ratchet connection to a ratcheted support fixed in said headrail, for translating said chain guide along said headrail axis to tension said chain.

22. The venetian blind of claim 1 further comprising a pair of draw cords extending through a pair of spaced apertures in each of said slats, said draw cords being anchored in a bottom rail of said blind and extending through a pair of plastic draw cord guides in said headrail, said guides including a bore for reception of a screw mounting said headrail to a window frame.

23. The venetian blind of claim 1 in which said at least one channel comprises two spaced channels extending across said headrail, each of said channels being fixed to a bottom wall of said headrail by an eyelet, said blind raising and lowering means including draw cords, said draw cords extending through said eyelets.

24. The venetian blind of claim 23 in which each of said channels includes an integral cord guide for guiding the draw cords through said channels, said cord guide including a vertical bore for reception of a blind mounting screw.

25. The venetian blind of claim 1 where said at least one guide channel includes a stop means for limiting the to and fro motion of said clamping blocks and said looped chain.

26. In combination, a double-glazed window and a venetian blind, said blind being fixed between glass panes of said window and comprising:

a series of horizontal slats extending from a headrail, said headrail containing a slats-tilting mechanism and means for raising the slats to a slats stacked position and for lowering the slats to an extended position, said slats-tilting mechanism comprising:

at least one elongated channel fixed in said headrail along a headrail longitudinal axis;

at least two pairs of clamping blocks in said channel, each being movable in said channel in a to and fro direction parallel to said headrail axis;

at least two slat ladders, each having two ladder legs with upper distal ends;

means for fixedly attaching the distal ends of the ladder legs to said clamping blocks;

a looped chain having spaced portions fixed to said clamping blocks;

means for driving said chain in partial orbital directions such that the ladder legs of each pair of ladder legs are pulled in opposite directions by opposing motion of opposite sides of said looped chain to thereby tilt said slats; and wherein said means for driving said chain includes a tilt wand mechanism extending from said headrail to a wand position exterior of said doublespaced window.

27. A venetian blind comprising:

a series of horizontal slats extending from a headrail to a bottom rail;

draw cord means including draw cords anchored in said bottom rail and extending through apertures in said slats to said headrail for lowering and raising said slats;

means in said headrail for tilting said slats; and means in said headrail for guiding said draw cords and connecting said headrail to a window frame surface, said means for guiding and connecting comprising at least one vertical gate having a through aperture for guiding said draw cords in said headrail and a gate leg having a vertical bore for reception of a headrail mounting screw.

28. The venetian blind of claim 27 in which said at least one vertical gate is of inverted U-shape and extends from an interior bottom surface of said headrail to a position immediately adjacent the top of said headrail such that the mounting screw is not exposed in said headrail.

29. A venetian blind comprising:

a series of horizontal slats extending from a headrail to a bottom rail;

draw cord means including draw cords anchored in said bottom rail and extending through apertures in said slats to said headrail for lowering and raising said slats;

means in said headrail for tilting said slats;

means in said headrail for locking said draw cords, said means for locking including a headrail outlet for exit of said draw cords;

a guide pin extending vertically adjacent a rear corner of said headrail, said draw cords being positioned to extend between said pin and said headrail corner and outward through said outlet;

a spring-operated cam pivotably mounted in said headrail and having a distal end pivotably movable in a first direction across said outlet by spring action for jamming and locking said draw cords between said distal end and a surface of said headrail, said cam being releasable and pivoted in a return direction by a force moment against said cam by pulling a portion of said draw cords extending from said outlet;

further including a vertical camming surface in said headrail and wherein said spring-operated cam includes an integral spring arm extending from a proximate end of said spring cam opposite said distal end, said arm having an outer surface in camming contact with said vertical camming surface in said headrail; and in which said guide pin, said headrail outlet, said vertical camming surface and a vertical pivot pin for said spring-operated cam is of one-piece construction forming a unitary headrail end section fixedly mounted in said headrail.

30. The venetian blind of claim 29 in which said means for tilting said slats includes a looped beaded chain movable to and fro longitudinally in said headrail and further including a chain guide having a ratcheted base ratchetly movable with respect to a ratcheted support to tension said chain, said support being integral with and extending from said unitary headrail end section.

31. A venetian blind comprising:

a series of horizontal slats extending from a headrail to a bottom rail;

draw cord means including draw cords anchored in said bottom rail and extending through apertures in said slats to said headrail for lowering and raising said slats;

means in said headrail for tilting said slats; and wherein said means for tilting further includes a drive gear, a tilt wand extending from said headrail and a wand connector rod, said rod being torque connected to said wand at a rod lower end and including a bifurcated upper end insertible into a bore in said drive gear.

* * * * *